US006515414B1

(12) United States Patent
Cathey et al.

(10) Patent No.: US 6,515,414 B1
(45) Date of Patent: Feb. 4, 2003

(54) LOW WORK FUNCTION EMITTERS AND METHOD FOR PRODUCTION OF FED'S

(75) Inventors: David A. Cathey, Boise, ID (US); Surjit S. Chadha, Meridian, ID (US); Behnam Moradi, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/564,356

(22) Filed: May 1, 2000

Related U.S. Application Data

(62) Division of application No. 09/105,613, filed on Jun. 26, 1998, now Pat. No. 6,057,638, which is a division of application No. 08/543,819, filed on Oct. 16, 1995, now Pat. No. 5,772,488.

(51) Int. Cl.[7] ..... H01J 1/62; H01J 63/04

(52) U.S. Cl. ..... 313/495; 313/309; 313/310; 313/336; 313/346 R; 313/351

(58) Field of Search ..... 313/496, 495, 313/309, 310, 336, 346 R, 351

(56) References Cited

U.S. PATENT DOCUMENTS

| | | | | |
|---|---|---|---|---|
| 3,921,022 A | * | 11/1975 | Levine | 313/309 |
| 4,325,000 A | | 4/1982 | Wolfe et al. | 313/336 |
| 4,940,916 A | | 7/1990 | Borel et al. | 313/309 X |
| 5,089,292 A | | 2/1992 | MaCaulay et al. | 427/78 |

(List continued on next page.)

FOREIGN PATENT DOCUMENTS

JP 1-235124 9/1989

OTHER PUBLICATIONS

Evtukh et al., "Parameters of the Tip Arrays Covered by Low Work Function Layers," *J. Vac. Sci. Tech. B.* 14(3), pp. 2130–2134 Pub. (May–Jun., 1996).

Evtukh et al., Jul. 30, 1995 "Parameters of the Tip Arrays Covered by Low Work Function Layers," *Institute of Semiconductor Physics Academy of Sciences*, Prospect Nauki 45, Kiev–252028, Ukraine (Aug. 1995).

Bauch et al., Apr. 1989 "Effect of Cs Contamination on the Interface State Density of Mnos Capacitors,." *Applied Surface Science* 39:356–363.

Macaulay et al., Aug. 24, 1992 "Ceslated thin–film field-emission microcathode arrays," *Appl. Phys. Lett.* vol. 61, No. 8, pp. 997–999.

Branston et al., Oct. 1991 "Field Emission from Metal-Coated Silicon Tips," *IEEE Transactions on Electron Devices*, vol. 38, No. 10, pp. 2329–2333.

Michaelson H.B., Jan. 1978 "Relation Between an Atomic Electronegativity Scale and the Work Function," *IBM J. Res. Develop.*, vol. 22, No. 1, pp. 72–80.

Ea et al., Jul. 1990 "Avalanche Electron Emission Cathode Array," *Vacuume Microelectronics Conference.*

*Primary Examiner*—Vip Patel
*Assistant Examiner*—Kevin Quarterman
(74) *Attorney, Agent, or Firm*—Hale and Dorr LLP

(57) ABSTRACT

According to one aspect of the invention, a field emission display is provided comprising: an anode; a phosphor screen located on the anode; a cathode; an evacuated space between the anode and the cathode; an emitter located on the cathode opposite the phosphor; wherein the emitter comprises an electropositive element both in a body of the emitter and on a surface of the emitter. According to another aspect of the invention a process for manufacturing an FED is provided comprising the steps of: forming an emitter comprising an electropositive element in the body of the tip; positioning the emitter in opposing relation to a phosphor display screen; creating an evacuated space between the emitter tip and the phosphor display screen; and causing the electropositive element to migrate to the an emission surface of the emitter.

16 Claims, 1 Drawing Sheet

U.S. PATENT DOCUMENTS 5,186,670 A 2/1993 Doan et al. ..... 445/24
5,210,472 A 5/1993 Casper et al. ..... 315/349
5,229,331 A 7/1993 Doan et al. ..... 437/228
5,358,908 A 10/1994 Reinberg et al. ..... 438/20
5,391,259 A 2/1995 Cathey et al. ..... 156/643
5,449,970 A * 9/1995 Kumar et al. ..... 313/495
5,469,014 A 11/1995 Itoh et al. ..... 313/311 X
5,495,143 A * 2/1996 Lengyel et al. ..... 313/574
6,057,638 A * 5/2000 Cathey et al. ..... 313/311

* cited by examiner

LOW WORK FUNCTION EMITTERS AND METHOD FOR PRODUCTION OF FED'S

CROSS-REFERENCE TO RELATED APPLICATION

This application is a divisional of application Ser. No. 09/105,613, filed Jun. 26, 1998, now U.S. Pat. No. 6,057,638; which is a divisional of application Ser. No. 08/543,819, filed Oct. 16, 1995, now U.S. Pat. No. 5,772,488, which is expressly incorporated by reference for all purposes.

GOVERNMENT RIGHTS

This invention was made with government support under Contract No. DABT 63-93-C0025 awarded by Advanced Research Projects Agency (ARPA). The government has certain rights in this invention.

BACKGROUND OF THE INVENTION

This invention relates to field emission displays, and more particularly to the formation of low work function emitters.

The required turn-on voltage for an emitter at a constant current is a function of the work function of the material at the surface of the emitter. For example, see U.S. Pat. No. 4,325,000, issued Apr. 13, 1982, incorporated herein by reference, and Michaelson, H. B. "Relation Between An Atomic Electronegativity Scale and the Work Function," 22 IBM Res. Develop., No. 1, January 1978. Reduction of the work function of a material can be achieved by coating the surface with an electropositive element. For example, see U.S. Pat. No. 5,089,292, incorporated herein by reference. However, such knowledge has never been translated into a useful field emission display. Electropositive materials are very reactive, and, therefore, upon coating on an emitter, they quickly begin to react with most atmospheres, resulting in a high work function material coating the emitter. Accordingly emitters coated with low work function materials on the surface have traditionally not been useful. Also, the compositions in which electropositive elements normally exist (for example, as a salt with Cl) include elements that have a very large work function (e.g. Cl).

The present invention provides solutions to the above problems.

SUMMARY OF THE INVENTION

According to one aspect of the invention, a field emission display is provided comprising: an anode; a phosphor located on the anode; a cathode; an evacuated space between the anode and the cathode; an emitter located on the cathode opposite the phosphor; wherein the emitter comprises an electropositive element both in a body of the emitter and on a surface of the emitter.

According to another aspect of the invention a process for manufacturing an FED is provided comprising the steps of: forming an emitter comprising an electropositive element in the body of the tip; positioning the emitter in opposing relation to a phosphor display screen; creating an evacuated space between the emitter tip and the phosphor display screen; and causing the electropositive element to migrate to the an emission surface of the emitter.

DESCRIPTION OF THE DRAWINGS

For a more complete understanding of the present invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION

Figure 1:
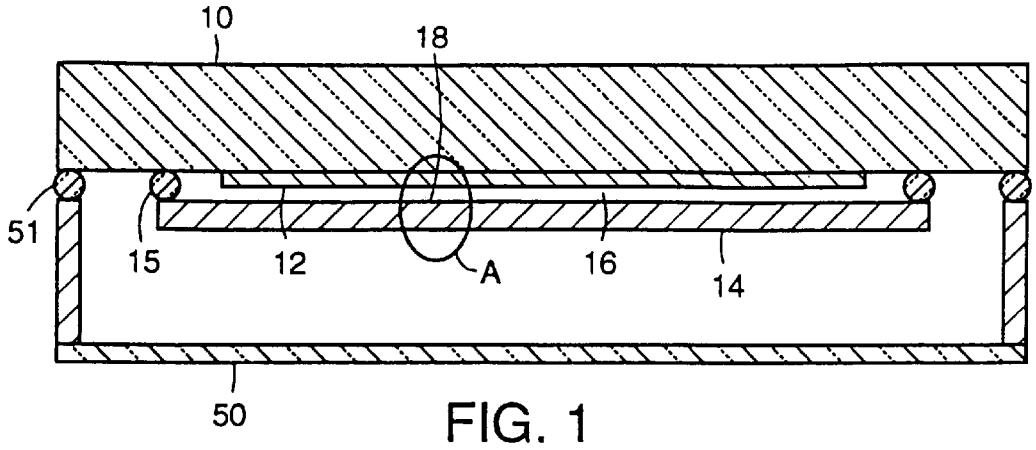
FIG. 1 is a side view of an embodiment of the present invention.

Referring now to FIG. 1, a field emission display 1 according to the present invention is shown comprising: an anode 10, which in this embodiment comprises a faceplate, or screen of the field emission display. This embodiment further comprises a phosphor screen 12, located on the anode 10; a cathode 14, attached to anode 10 by glass frit 15; and an evacuated space 16 between the anode 10 and the cathode 14.

Figure 2:
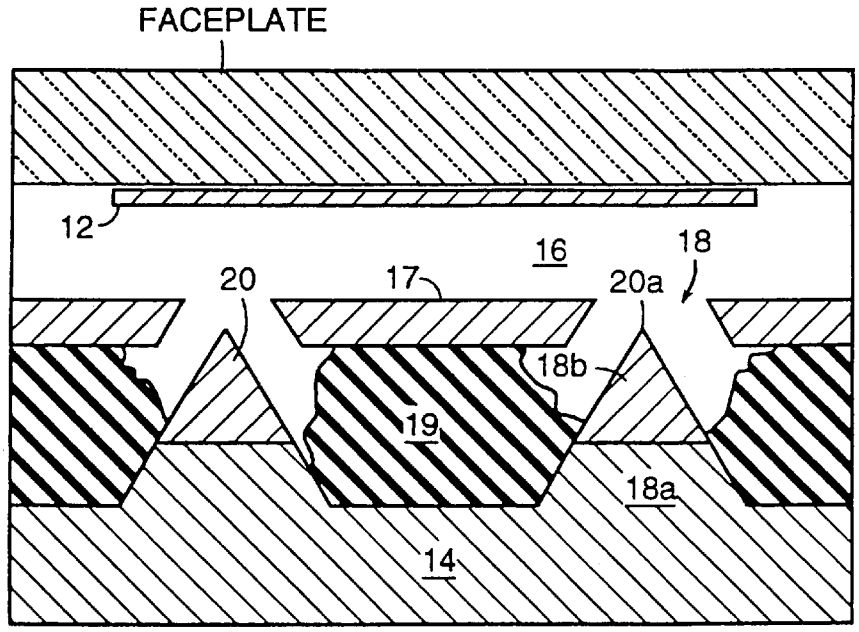
FIG. 2 is a side view of a detailed area of FIG. 1.

Referring now to FIG. 2, a more detailed view of cathode 14 in the region of circle A of FIG. 1 is seen comprising: an emitter tip 18 located on the cathode 14 opposite the phosphor screen 12. In this embodiment of the invention, the emitter tip 18 comprises an electropositive element 20 both in a body 18*a* of the emitter tip 18 and on a surface 18*b* of the emitter tip 18. Spaced from emitter tip 18 by dielectric 19 is grid electrode 17. In this embodiment, the distribution of the electropositive element 20 in the body 18*a* of the emitter tip 18 is substantially even. However, according to an alternative embodiment, the distribution is more uneven, wherein there is a gradient of the electropositive element 20 in the body 18*a* and the surface 18*b* is substantially all electropositive element 20. According to one specific embodiment, the distribution is an exponential change, and the electropositive element is provided in the body 18*a* such that the work function of the surface 18*b* of emitter tip 18 is reduced by at least 50%. For example, in the case of an amorphous silicon emitter tip, the work function is 3.9 eV without an electropositive component, and about 2.0 eV if Na is doped according to the dip process described below.

Acceptable specific elements for electropositive element 20 are chosen from groups IA, IIA, and IIIA of the periodic table. One specific element known to be useful as electropositive element 20 comprises Cs. Another element known to be useful comprises Na. Others known or believed to be useful comprise: H, Li, Be, B, Mg, Al, Ga, Ba, Rb, Ca, K, Sr, and In.

An example process for manufacturing a field emission display ("FED") according to the present invention comprises the steps of: forming an emitter tip 18 comprising an electropositive element 20 in the body 18*a* of the emitter tip 18; positioning the emitter tip 18 in opposing relation to a phosphor screen 12 on the display; creating an evacuated space 16 between the emitter tip 18 and the phosphor screen 12; causing the electropositive element 20 to migrate to the emission surface 18*b* of the emitter tip 18, whereby the display of FIG. 2 results.

According to an example process of forming the emitter tip as in FIG. 2, the emitter tip 18 is formed by methods that will be understood by those of skill in the art (for example, see U.S. Pat. Nos. 4,940,916; 5,391,259; and 5,229,331, all of which are incorporated herein by reference), and the substrate with the emitter tip 18 is contacted with a solution in a glass container. The solution comprises an electropositive element as the solute, and a solvent (for example, alcohol). Other solvents believed to be useful according to other embodiments of the invention include: water, acetone, or any other solvent capable of dissolving electropositive salts.

As mentioned above, said electropositive element comprises an element chosen from groups IA, IIA, and IIIA of the periodic table. One specific element known to be useful as electropositive element comprises Cs. Others known or believed to be useful comprise: H, Li, Be, B, Na, Mg, Al, Ga, Ba, Rb, Ca, K, Sr, and In.

According to one example of the present invention,the contacting comprises dipping the emitter tip into the solution for a time sufficient to cause $10^{21}$ atoms/$cm^3$ of electropositive material to penetrate into the emitter tip. Some acceptable solutions, dip times, and dip temperatures are listed below (other examples will occur to those of skill in the art):

| Solution Composition | Dip Time | Dip Temperature (Degrees C.) |
|---|---|---|
| propan-1-ol solvent - NaCl solute | 15 minutes | 82 |
| methanol solvent -CsCl solute | 15 minutes | 62 |
| ethanol solvent - NaCl solute | 15 minutes | 75 |
| methanol solvent NaCl solute | 15 minutes | 62 |
| propan-1-ol solvent - CsCl solute | 15 minutes | 82 |
| ehtanol solvent - CsCl solute | 15 minutes | 75 |

In a more specific embodiment, a silicon substrate from which the emitters have been shaped is dipped in a solution of propan-2-ol, as the solvent, and CsCl, the solution being kept just under the boiling temperature. Next, either amorphous silicon (a-Si) or micro crystalline silicon (u-Si) is deposited at between about 200 degrees C. and about 300 degrees C. (for example, by plasma-enchanced chemical vapor deposition). Thus, the Cs layer is protected from reaction with other elements by the silicon deposition during further handling. Once the display is ready for assembly, the various components of FIG. 1 are brought together in a vacuum, and then sealed and heated. Since in a-Si and u-Si the density of surface states is high, most of the Cs atoms will migrate to the surface of emitter tip 18 and be trapped right at the surface of the deposited films, where a cesium rich monolayer 20*a* is created.

In another specific embodiment, a glass substrate with 7000 angstrom amorphous silicon emitters formed thereon was dipped in a solution of propan-1-ol, as the solvent, and NaCl for 15 minutes at a temperature just below boiling. The result was an approximately 7000 angstrom alpha-silicon/glass structure with Na doped therein. SIMS analysis of H, P, and Na were conducted comparing a similar sample which had not been dipped. The NaCl dipped structure had about 500 times higher Na near the Si surface (at about 500 angstroms depth) then the sample which had not been dipped. The Na level remained higher throughout the 7000 angstroms tested, but decreased to about 80 times higher near the Si/glass interface (at about 6000 angstroms). Further, the dipped sample included a slightly higher P than the undipped sample, but the difference was less than about 1.5 times. No H difference was seen between the samples. Mo contamination (due to use of a furnace having therein) was detected on the NaCl dipped sample, but no Mo was seen in the undipped sample. Mo contamination is avoided in other embodiments. Higher K and Ca were also observed in the NaCl dipped sample. Surprisingly, Cl was not detected in either the dipped or undipped sample. This is an important finding as Cl has a high work function and is undesirable in the emitter tip.

According to still a further embodiment, the emitter tip is made after the substrate from which the emitter tip is formed is doped with an electropositive element. For example, according to one alternative embodiment of the invention, the substrate on which the emitter tip is manufactured is dipped, before the formation of the emitter tip, and the emitter tip is then formed on the substrate. According to specific examples of processes believed to be acceptable according to this embodiment, the following parameters are used:

| Solution Composition | Dip Time | Dip Temperature (Degrees C.) |
|---|---|---|
| propan-1-ol solvent - NaCl solute | 15 minutes | 82 |
| methanol solvent - CsCl solute | 15 minutes | 62 |
| ethanol solvent - NaCl solute | 15 minutes | 75 |
| methanol solvent NaCl solute | 15 minutes | 62 |
| propan-1-ol solvent - CsCl solute | 15 minutes | 82 |
| ethanol solvent - CsCl solute | 15 minutes | 75 |

According to still a further embodiment, plasma-enhanced chemical vapor deposition is used to place the electropositive element in the body of the emitter tip. As before, the vapor deposition is conducted either before or after the formation of the emitter tip. After the vapor deposition, heating will cause diffusion of the electropositive element into the body of the emitter tip. After assembly in an evacuated space, subsequent heating causes the material to migrate to the surface of the emitter tip, where it will not react due to the vacuum, and a low work function emitter tip is thereby achieved.

Another acceptable method of placement of the electropositive element in the body of the emitter tip is through ion-implantation, again followed by heating after evacuation to cause diffusion.

In embodiments in which the electropositive element is applied before the emitter tip is formed, some of the electropositive element will be exposed during subsequent steps, such as etching. When this occurs, an oxide or non-volatile salt will form, depending upon the atmosphere at the surface of the emitter tip when exposure occurs. In these embodiments, the oxide or non-volatile salt which is rinsed (for example, with buffered oxide etchant in the case of oxide or water in the case of salt), before further processing. Acceptable examples of materials for the substrate which is doped with the electropositive element include, for example, Si, Mo, Cr, and W. Others will occur to those of skill in the art.

Other steps to form the emitter tip and other structures of the FED will be understood by those of skill in the art and require no further explanation here.

Figure 3:
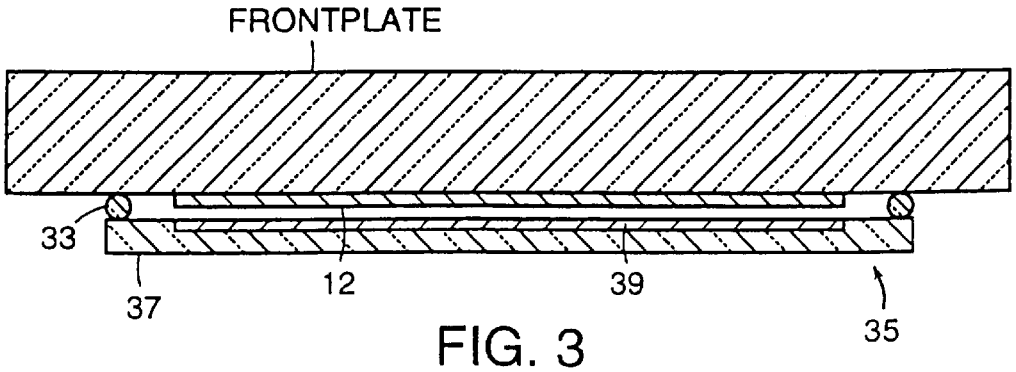
FIG. 3 is a side view of an alternative embodiment to the embodiment of the invention seen in FIG. 1.

According to some embodiments (for example, see FIG. 3), the display is sealed by glass frit seal 33, chosen to match the thermal expansion characteristic of the cathode 35, which, in this embodiment, comprises a glass substrate 37 on which emitters 39 are formed. This embodiment is particularly useful for large area displays. The sealing is done in a vacuum space by heating the entire device. The heating to a seal temperature for the frit 33 (for example, 450 degrees C. for a lead-glass-based frit), causes the migration of the electropositive element to the surface of the emitters 39.

According to still a further embodiment, seen in FIG. 1, the cathode 14 is encased by a backplate 50, which is also sealed in vacuum by a frit 51 by heating. This embodiment is useful in small area displays where, for example, the cathode 14 comprises a silicon substrate onto which the emitters 18 are formed. Here, the cathode 14 is attached to faceplate 10 by another frit seal 15, also sealed by heating.

What is claimed is:

1. A field emission display comprising;

an anode;

phosphor located on the anode:

a cathode;

the anode and the cathode sealed together and spaced apart to define an evacuated space therebetween; and a plurality of electron emitters located on the cathode each having tips for emitting electrons to the phosphor, the emitters being made of silicon, wherein each of the emitters has electropositive element both throughout a body of the emitter and at a surface of the emitter.

2. A display as in claim 1, wherein the distribution of the electropositive element in the body of the emitters is substantially even.

3. A display as in claim 1, wherein the electropositive element is chosen from Group IA of the periodic table.

4. A display as in claim 1, wherein the electropositive element comprises Cs.

5. A display as in claim 1, wherein the electropositive element is chosen from a group consisting of H, Li, Be, B, Na, Mg, Al, Ga, Ba, Rb, Ca, K, Sr, and In.

6. A display as in claim 1, wherein the electropositive element is chosen from Group IIA of the periodic table.

7. A display as in claim 1, wherein the electropositive element is chosen from Group IIIA of the periodic table.

8. The display of claim 1, wherein the electropositive element is provided and distributed such that the work function is reduced by at least 50% compared to an emitter without the electropositive element.

9. The cathode of claim 1, wherein the electropositive element is provided and distributed such that the work function is reduced by at least 50% compared to an emitter without the electropositive element.

10. A cathode for a display device comprising:

a substrate;

a plurality of electron emitters on the substrate and made from silicon, the emitters having a relatively wide base on the substrate and tapering to a tip spaced from the substrate; and an electropositive element diffused in the emitters so that the concentration of the electropositive element decreases from the tip to the base, and wherein there is a significant amount of the electropositive element at the base.

11. A cathode as in claim 10, wherein the distribution of the electropositive element in the body of the emitters is substantially even.

12. A cathode as in claim 10, wherein the electropositive element is chosen from Group IA of the periodic table.

13. A cathode as in claim 10, wherein the electropositive element comprises Cs.

14. A cathode as in claim 10, wherein the electropositive element is chosen from a group consisting of H, Li, Be, B, Na, Ma, Al, Ga, Ba, Rb, Ca, K, Sr, and In.

15. A cathode as in claim 10, wherein the electropositive element is chosen from group IIA of the periodic table.

16. A cathode as in claim 10, wherein the electropositive element is chosen from group IIIA of the periodic table.

* * * * *

UNITED STATES PATENT AND TRADEMARK OFFICE

CERTIFICATE OF CORRECTION

PATENT NO. : 6,515,414 B1 
DATED : February 4, 2003
INVENTOR(S) : David A. Cathey, Surjit S. Chadha and Behnam Moradi It is certified that error appears in the above-identified patent and that said Letters Patent is hereby corrected as shown below:

Column 6,
Line 28, "Ma." should be -- Mg. --.

Signed and Sealed this

Third Day of June, 2003

JAMES E. ROGAN
*Director of the United States Patent and Trademark Office*